US005211284A

United States Patent [19]

Parks

[11] Patent Number: 5,211,284

[45] Date of Patent: May 18, 1993

[54] JEWELRY CHAIN HOLDER

[76] Inventor: Gail H. Parks, 238 Lake Almanor West Dr. (P.O. Box 415), Chester, Calif. 96020

[21] Appl. No.: 729,586

[22] Filed: Jul. 15, 1991

[51] Int. Cl.[5] ..... A45C 11/04

[52] U.S. Cl. ..... 206/6.1; 206/348; 206/493; 206/495; 220/666

[58] Field of Search ..... 206/6.1, 49, 45.34, 206/388, 485, 486, 493, 495, 348; 211/13, 60.1, 61, 70.1; 229/93; 220/666, DIG. 7

[56] References Cited

U.S. PATENT DOCUMENTS

| | | | |
|---|---|---|---|
| 671,823 | 4/1901 | Gray | 229/93 |
| 1,639,672 | 8/1927 | Schraysshuen | 206/486 X |
| 2,377,042 | 5/1945 | Rosenthal | 428/36.9 X |
| 2,624,457 | 1/1953 | Jablon | 206/486 X |
| 3,612,612 | 10/1971 | Gannon . | |
| 3,796,370 | 3/1974 | Speers et al. | 229/93 X |
| 3,876,065 | 4/1975 | Phelps . | |
| 3,981,395 | 9/1976 | Dalgleisch | 206/445 X |
| 3,997,050 | 12/1976 | Patterson . | |
| 4,016,972 | 4/1977 | Szamborski . | |
| 4,120,394 | 10/1978 | Soltes . | |
| 4,401,219 | 8/1983 | Mink . | |
| 4,530,865 | 7/1985 | Sprenger | 428/369 X |

FOREIGN PATENT DOCUMENTS

| | | | |
|---|---|---|---|
| 2011573 | 9/1971 | Fed. Rep. of Germany | 206/486 |

OTHER PUBLICATIONS

U.S. Cavalry Store, Inc. (1984 Catalog, p. 53).

*Primary Examiner*—Bryon P. Gehman
*Attorney, Agent, or Firm*—Michael A. Kaufman

[57] ABSTRACT

A jewelry chain holder includes two tube-like structures joined together by a common partition wall in a side-by-side disposition, each tube defining a channel-like cavity and a longitudinal slit running the full tube length and preferably located on a portion of the tube somewhat opposite from the partition wall. The length of each tube approximates half the total chain length, and the cross-section of each cavity is sufficiently large to contain a cross-section of the chain within. Preferably the tube-like structures are transparent and made of a slightly resilient material that permits a user to force approximately half the chain length into each cavity through the longitudinal slit. The result is that substantially the entire chain is maintained in a stretched out disposition within the two cavities, the partition wall separating the two chain halves. So held, the chain is visible from 360° and is protected by the exterior of the tube-like structures from dust, scratching and other damage. Because the chain halves are held slightly taut, the chain is not free to tangle and kink, despite the orientation of the holder. The disclosed holder is inexpensively constructed, is light weight, and may be used to display or maintain a jewelry chain during storage, transportation and the like.

17 Claims, 3 Drawing Sheets

JEWELRY CHAIN HOLDER

FIELD OF THE INVENTION

This invention relates to devices for holding jewelry, and more particularly to devices for holding and protecting a jewelry chain such as a necklace.

BACKGROUND OF THE INVENTION

Many devices are known in the art for holding and protecting a jewelry chain. U.S. Pat. No. 3,876,065 issued to Phelps discloses a rigid, transparent tube wherein jewelry is suspended from a cap piece. The tube is maintained in a vertical disposition by a base holder. U.S. Pat. No. 3,997,050 to Patterson discloses a vertical caddy with outwardly projecting hooks from which jewelry may be suspended.

Unfortunately unless they remain vertical, such devices do not adequately retain a jewelry chain. This limitation makes such devices somewhat marginal when used to transport jewelry, since a vertical disposition may not always be maintained. Further such devices do not adequately prevent the links in a jewelry chain from twisting or kinking together, resulting in a tangled chain. Finally, such devices are not generally inexpensively mass produced, and do not yield a light weight jewelry chain holder.

SUMMARY OF THE INVENTION

Accordingly it is an object of the invention to provide a light weight device that can be inexpensively mass produced and that can hold a jewelry chain in a non-vertical disposition.

It is a further object of the invention to provide a device that will hold and protect a jewelry chain against kinking, twisting and tangling.

It is yet another object of the invention to provide a device that will protect substantially the entire jewelry chain against dust and contact with foreign objects that might scratch the chain.

Finally, it is an object of the invention to provide a device that will allow a jewelry chain held therein to be viewed substantially from 360°.

A jewelry chain holder according to the present invention includes at least one tube-like structure that defines a channel-like cavity extending the tube length. The cross-section of this cavity is sufficiently large to accommodate within the channel a cross-section of the jewelry chain. The structure includes a slit running the entire structure length, which length is approximately half the length of the chain when unlooped. The structure is preferably made from a slightly resilient and transparent material such as plastic.

A user pushes a portion of a joined or looped-together chain through the slit into channel-like cavity within the structure. Half the chain length will fit within the cavity, the remaining chain half emerging from the structure and being maintained against the outer structure wall. Because the structure length approximates the length of the looped chain, the chain is retained slightly taut. So retained, the chain will not tangle or kink, regardless of whether the structure is maintained in a vertical disposition. The chain half within the structure is protected against dust and contact with foreign objects.

Preferably a chain holder comprises two such structures joined lengthwise in a side-by-side fashion. The slit in each structure is preferably somewhat opposite from the common wall region joining the two structures. A user pushes half the chain length through the slit in each structure. The chain will be maintained in a somewhat taut disposition within the channel-like cavities, with the common wall region between the cavities separating the two chain halves. The only portions of the chain not so protected will be the few chain links at the top and bottom of the holder which exit the cavity in one structure, bend 180° and enter the cavity in the adjacent structure. The chain holder is preferably fabricated as a single longitudinal member that defines two hollow channels and two slots, each channel sized to admit and retain half the chain length.

If the holder is made from a transparent material such as plastic, the chain held within will be visible from essentially 360°. Preferably the common wall region at ends of each tube or each channel includes a short second slit. This additional slit helps anchor the chain, and provides some protection to the few chain links otherwise totally exposed. Optionally, an upper end of each tube or channel can include a short third slit on either side of the common wall region to help anchor a clasp.

Other objects, features and advantages of the invention will appear from the following description in which the preferred embodiments have been set forth in detail, in conjunction with the accompanying drawings.

DETAILED DESCRIPTION OF THE PREFERRED EMBODIMENTS

Figure 1A:
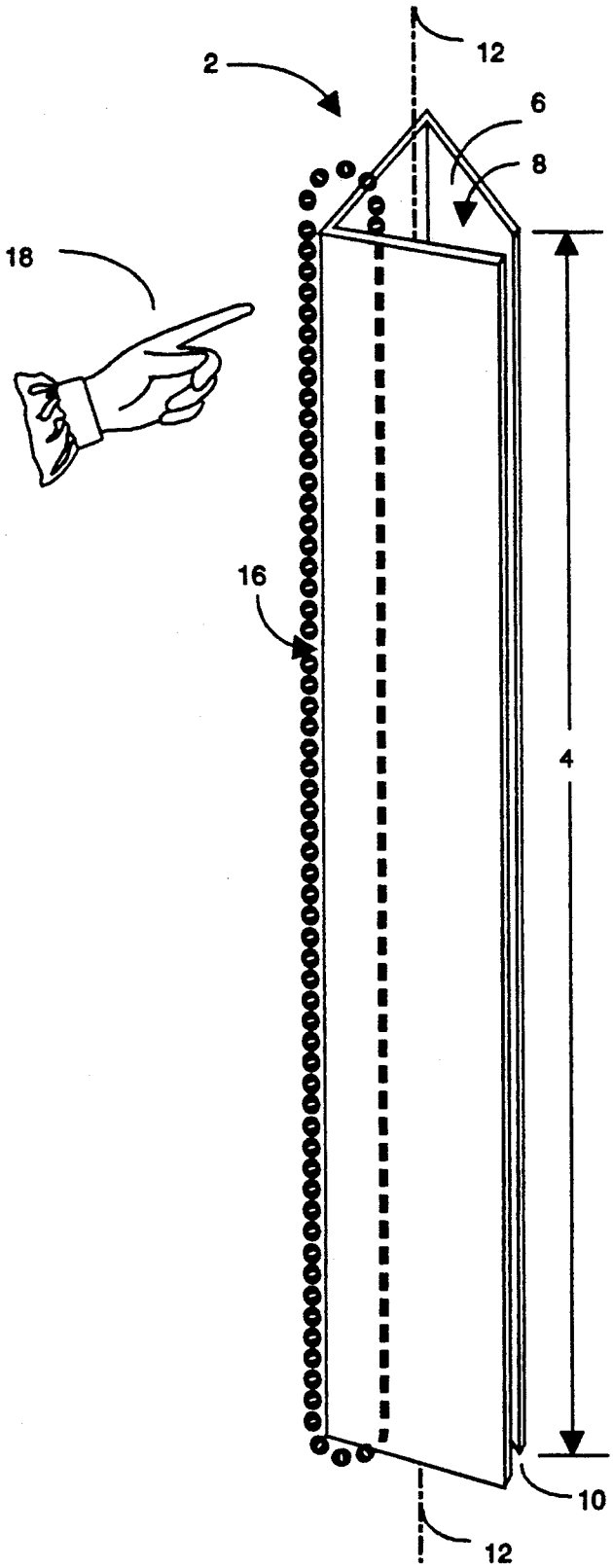
FIG. 1A is a perspective view of a prototype embodiment of the present invention.

FIG. 1A shows the simplest embodiment of the present invention. A hollow tube-like structure 2 has a length 4, a cross-section area shown generally as 6, and defines a channel-like cavity region 8 extending the full length 4. A slot 10 runs the full length 4 of the structure 2, generally parallel to a longitudinal axis 12. In FIG. 1A, the slot 10 is disposed essentially diametrically opposite from the structure main wall 14, although the slot 10 could be located closer to wall 14 if desired. FIG. 1A shows a chain necklace 16 whose total length when unlooped is approximately twice the length 4 of the structure 2. The structure cross-section area 6 is large enough to permit the cross-section of the chain 16 to fit within the structure 2.

Preferably the structure 2 is made of an inexpensive, light weight, material that is slightly resilient. If the material is a biodegradable paper, the structure may readily be disposed of after use. However it is advantageous to use a transparent material, plastic for example, that allows the structure 2 to be repeatedly, and allows the chain 16 to be seen through the structure 2.

In practice, a user 18 inserts approximately half the chain length through the slot 10 into the channel-like cavity region 8 of the structure 2. Because it is preferably somewhat resilient, the structure material in the region of the slot 10 will "give" slightly, enabling the user 18 to force half the chain length through the slot 10 into the cavity region 8. The remainder of the chain 16 will remain external to the structure 2, being held against the external surface of the wall 12. Any clasp 18 of the chain 14 may conveniently be located external to the structure 2 as shown. If the clasp is not too bulky, it could be either forced through the slot 10 into the cavity 8, or the chain 16 in FIG. 1A could be "rotated" such that the clasp 20 is moved into the cavity 8.

Because the length 4 of the structure 2 is made to approximately the length of the chain 18 (when the chain 18 is formed into a loop), the chain 18 is held slightly tautly within and against the structure 2. So held, the chain 18 is not free to twist, kink or tangle, regardless of whether the structure 2 is in a vertical, a horizontal or some intermediate disposition. Further, the chain half length that is held within the cavity region 8 is protected by the structure 2 from dust or contact with foreign objects that might scratch or otherwise harm that chain half. In addition, if the structure 2 is made of a transparent material, the chain half held within the cavity region 8 will be visible, essentially over a 360° viewing angle.

Figure 1B:
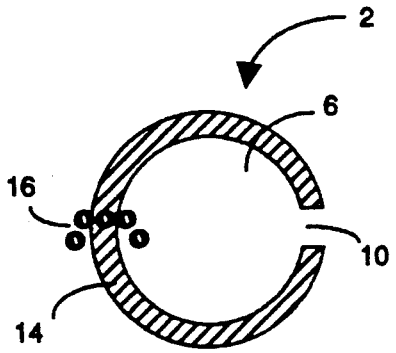
FIGS. 1B and 1C are plan views of alternate structure shapes.
Figure 1C:
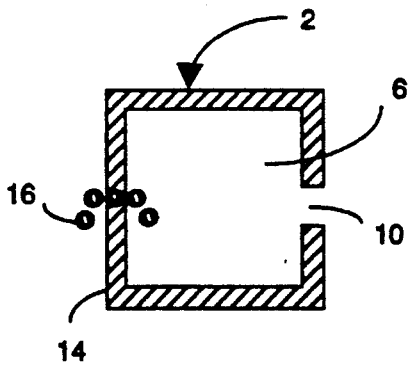

While FIG. 1A shows a structure 2 having a generally triangular cross-section, other shapes may be used. FIG. 1B shows a structure 2 defining an essentially circular cross-section, while FIG. 1C shows a structure 2 defining a somewhat square or rectangular cross-section In practice the method of producing the structure 2 might dictate cross-section shape. Applicant believes that an extruding process might be preferred to manufacture the structure 2, possibly using a polyethylene type plastic material.

Figure 2:
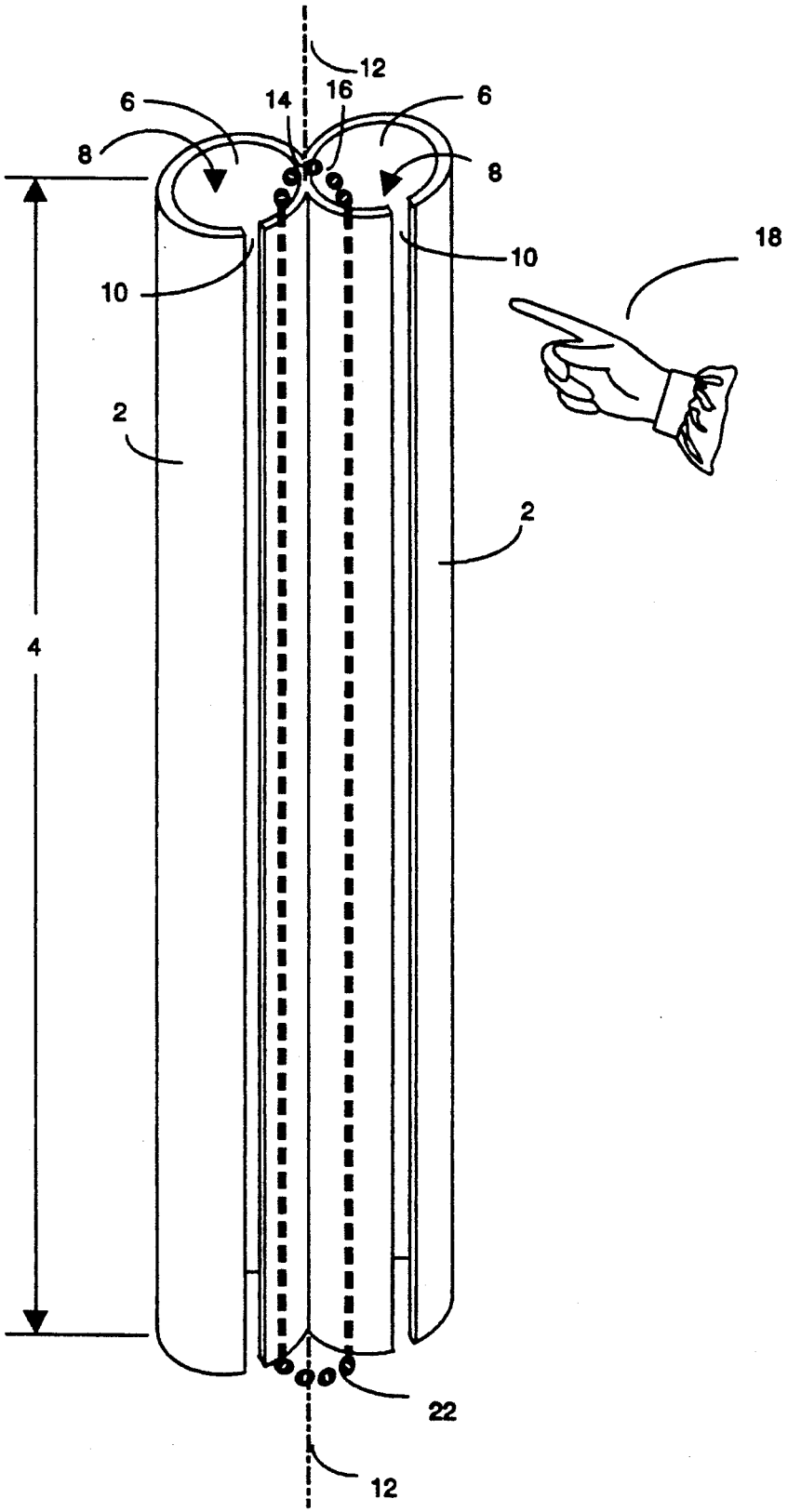
FIG. 2 is a perspective view of a preferred embodiment of the present invention.

FIG. 2 is a perspective view of a preferred embodiment that protects substantially the entire length of the chain 16 from dust and contact with foreign objects. Two structures 2 are joined together lengthwise in a side-by-side fashion along common walls 14. Each structure 2 again defines a slot 10 running lengthwise, preferably parallel to a longitudinal axis 12. As before, the length 4 of each structure 2 approximates the length of a looped together chain 16, and the cross-section area 6 of each cavity 8 is sufficiently large to retain therein the cross-section of the chain 16. Applicant has made a sample holder as shown in FIG. 2 from two plastic drinking straws, slit lengthwise and joined together. Other materials could of course be used. If the holder is made from two structures 2, they may be joined together side-by-side using a variety of techniques, including using glue, fusing with heat, or providing each structure with mating grooves and projections such that two structures 2 mate.

A user 18 now forces half of the chain 16 through each slot 10. Since the surrounding material is preferably slightly resilient (a plastic material, for example), the chain 16 forces its way through the slots 10 into the channel-like cavities 8 defined by each structure 2. As shown in FIG. 2, substantially the entire length of the chain 16 will be maintained within the cavities 8, with the common wall 14 that partitions or separates each cavity 8 also separating the two chain halves. So held, essentially the entire chain 16 is protected from dust and foreign objects, yet will be visible from 360° when the structures 2 are made from a transparent material. Since the structure length 4 approximates the length of the looped chain 16, the chain 16 is maintained sufficiently taut to prevent kinking, twisting, and tangling, regardless of the orientation of the structures 2.

The exact location and orientation of the slots 10 is not critical. For example, the embodiment of FIG. 2 shows the slots 10 approximately 90° removed from the common wall 14, whereas in FIG. 1A the slot 10 was essentially diametrically opposite or about 180° removed from the wall 14. Although FIG. 1A and FIG. 2 show a slot 10 defining a straight line, the slot 10 could instead define a spiral shape if desired. While FIG. 2 shows a jewelry chain holder made from structures 2 defining a somewhat circular cross-section, it is understood that other shapes could be used, including triangular, rectangular or square, parallelepipid, etc. (please see FIGS. 1B and 1C for examples). It is necessary that the cross-section be sufficiently large to admit within a cross-section of the chain 16. Further, while FIG. 2 shows identical structures 2 joined to form a chain holder, the present invention does not require that each structure 2 be identical, either in cross-section shape or size.

While the embodiment of FIG. 2 has been described in terms of two structures 2, in practice it may be preferable to manufacture the entire chain holder as a single unit. For example, plastic may be extruded in a shape defining a continuous longitudinal member having first and second channel-like cavities 8 separated by a common partition wall 14. The extruded material, preferably a transparent, light weight plastic, is then cut into members having lengths 4 appropriate for holding a chain whose looped length approximates the length 4. The surface of the member could be formed with a slot 10 communicating with each cavity 8 either during the initial manufacturing stage, or the slots 10 could be cut into the material after extrusion.

Figure 3A:
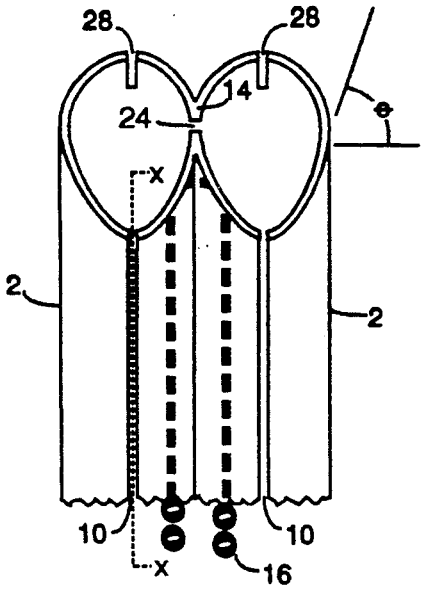
FIG. 3A is a perspective view of a top portion of a preferred embodiment of the present invention.
Figure 3B:
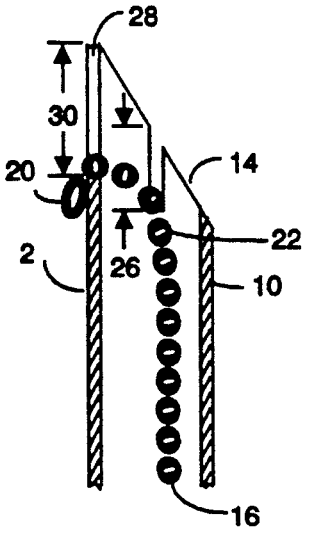
FIG. 3B is a partial view of the embodiment of FIG. 3A taken along the section line X—X.

As shown in FIG. 1A and FIG. 2, a few chain links 22 emerging from the ends of each structure 2 will be exposed to dust and possible contact with foreign objects. FIG. 3 A shows an alternative embodiment for an end section of a structure 2 that provides a second slot 24 in the common wall 14 to slightly recess the otherwise exposed links 22. The slot 24 has a length 26 of about $\frac{1}{8}''$–$\frac{1}{4}''$ (3 mm–6 mm), preferably parallel to the longitudinal axis 12. If desired the end surface of each structure 2 may be cut at an angle $\Theta$ (45° for example) to provide the user with easier access to the slot 24 for purposes of inserting or removing a chain 16 from the present invention. The additional slot 24 and/or canting angle $\Theta$ shown in FIGS. 3A and 3B may be provided at either or both ends of a structure 2. Optionally, an end surface of each structure 2 can include a third and preferably tapered slot 28, preferably not within the common wall 14, that has a length 30 of about $\frac{1}{8}''$–$\frac{1}{4}''$ (3 mm–6 mm). The slots 28 may be used to anchor a necklace clasp 20, especially a large clasp 20, external to the present invention. (Such use of slots 28 is shown in phantom in FIG. 3B.)

Figure 4A:
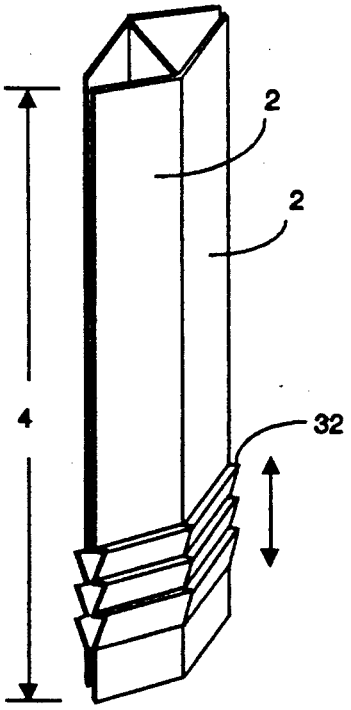
FIGS. 4A and 4B are perspective views showing adjustable length jewelry chain holders according to the present invention.
Figure 4B:
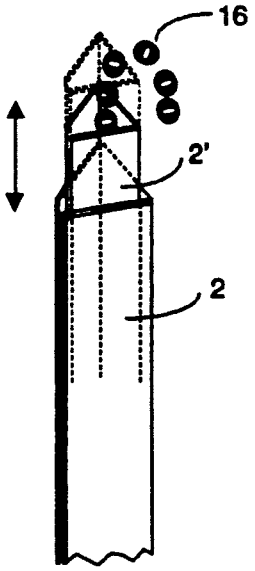

FIGS. 4A and 4B show how a chain holder according to the present invention may be varied in total length 4 to tautly retain a chain 16 whose looped length is either too long or too short to be otherwise properly retained. In FIG. 4A, the structures 2 comprising the holder include an accordion-like region 32 capable of expanding or contracting axially (as indicated by the arrow) to lengthen or shorten the total length 4 to properly retain a chain 16 (not shown). For ease of illustration, the telescopic embodiment of FIG. 4B shows only half a holder. In this embodiment, a structure 2 is provided with a similarly shaped structure 2' that is sized to fit snugly within structure 2 and telescopically slide axially in and out (as indicated by the arrow and phantom section) to vary the total length 4 of the combined structure. If the embodiments of FIG. 4A and 4B have an adjustable total length 4 of say about 12" (30 cm) to about 13" (33 cm), a chain holder so constructed will be able to retain a chain 16 whose total length (unlooped) is about 24" (61 cm) to about 26" (66 cm).

In summary, the present invention economically and simply provides a chain holder that is light weight, by virtue of its ease of manufacture and plastic material. Further, because the holder is preferably transparent and retains substantially all of a chain within, the chain is protected against dust and objects in any orientation, while remaining completely visible at all times. As such, the present invention is suitable for displaying a chain within and for transporting a chain within, notwithstanding that during transit the holder may be subjected to rough handling and various orientations.

Modifications and variations may be made to the disclosed embodiments without departing from the subject and spirit of the invention as defined by the following claims.

I claim:

1. A structure for holding and protecting a jewelry chain, the structure comprising:

a longitudinal member including first and second ends and a longitudinal length therebetween, and defining a longitudinal cavity and a longitudinal slit extending said longitudinal length;

said longitudinal member including means for contracting and expanding said longitudinal length axially to accommodate said structure holding a jewelry chain of a length different than said longitudinal length;

a cross-section of said longitudinal cavity being sufficiently large to hold a cross-section of a jewelry chain to be held by said structure;

wherein said slit permits entry into said longitudinal cavity of approximately a half length of a jewelry chain to be held, said longitudinal member maintaining a said jewelry chain in a stretched-out disposition.

2. The structure of claim 1, wherein said longitudinal member is made of a transparent material;

said transparent material permitting a jewelry chain held within said structure to be visible from substantially any viewing angle.

3. The structure of claim 1, wherein said longitudinal member is made of a slightly resilient material.

4. The structure of claim 1, wherein said longitudinal member is produced by extruding a plastic material.

5. The structure of claim 1, wherein said longitudinal member is a hollow tube.

6. The structure of claim 1, wherein said slit defines a line substantially parallel to a longitudinal axis of said longitudinal member.

7. A structure for holding a jewelry chain to prevent tangling and to protect the chain against dust and contacting foreign objects, while permitting visibility of the chain substantially over a 360° viewing angle, the structure comprising:

first and second hollow tubes joined together lengthwise along a common tube wall in a side-by-side disposition, each tube defining first and second open ends and a common longitudinal length therebetween, and a longitudinal slit running said longitudinal length, wherein said first and second tubes include means for contracting and expanding said longitudinal length to accommodate said structure holding a jewelry chain of a length different than said longitudinal length;

said first and second tubes being made from a transparent, slightly resilient material a cross-section of each tube being sufficiently large to hold a cross-section of a said jewelry chain to be held within each tube;

wherein said slits are sized to permit entry of into said respective first and second hollow tubes of respective halves of a said jewelry chain to be held in a stretched-out disposition therein when a said chain has a length approximately twice said longitudinal length.

8. A structure for holding and protecting a jewelry chain, the structure comprising:

a longitudinal walled member having first and second open ends and a longitudinal length therebetween, and defining within said walled member first and second longitudinal cavities extending said longitudinal length and separated by a longitudinal partition wall, and further defining first and second slots in said member extending said longitudinal length and communicating respectively with said first and second longitudinal cavities;

said first and second slots being sized to permit entry into said respective first and second longitudinal cavities of respective halves of a jewelry chain to be held by said structure without said first and second slots contacting a chain so held;

each said longitudinal cavity defining a cross-section sufficiently large to hold a cross-section of a jewelry chain to be held by said structure;

said structure holding a jewelry chain whose length approximates twice said longitudinal length in a stretched-out disposition within said cavities to minimize tangling and provide protection against dust and contact with foreign objects.

9. The structure of claim 8, wherein said longitudinal walled member is made of a slightly resilient material.

10. The structure of claim 8, wherein said longitudinal walled member is made of a transparent material;

said transparent material permitting a chain held within each said longitudinal cavity to be visible from substantially any viewing angle.

11. The structure of claim 8, wherein said longitudinal walled member is produced by extruding a plastic material.

12. The structure of claim 8, wherein said longitudinal walled member includes means for contracting and expanding said length of said longitudinal member axially;

said means for contracting and expanding permitting said length of said longitudinal walled member to be changed to accommodate holding a chain of a different length.

13. The structure of claim 8, wherein a cross-section of said longitudinal walled member defines two triangles joined at said partition wall, a region of each triangle defining one said slot.

14. The structure of claim 8, wherein a cross-section of said longitudinal walled member defines two circles joined at said partition wall, a region of each circle defining one said slot.

15. The structure of claim 8, wherein each said slot defines a line substantially parallel to a longitudinal axis of said longitudinal walled member.

16. The structure of claim 8, wherein an end surface of said longitudinal walled member defines an inclined plane with respect to a longitudinal axis of said longitudinal walled member.

17. The structure of claim 8, wherein an end region of said longitudinal walled member defines an additional slot having a length of between about ⅛" (3.2 mm) and about ¼" (6.4 mm).

* * * * *